US008727164B1

(12) United States Patent
Majcen et al.

(10) Patent No.: US 8,727,164 B1
(45) Date of Patent: May 20, 2014

(54) GAS RELEASE RESEALABLE TAB MECHANISM FOR A BEVERAGE CONTAINER

(76) Inventors: Marjan Majcen, South Orange, NJ (US); Beverly Burke-Majcen, South Orange, NJ (US); Robert Vreznik, South Orange, NJ (US)

( * ) Notice: Subject to any disclaimer, the term of this patent is extended or adjusted under 35 U.S.C. 154(b) by 0 days.

(21) Appl. No.: 13/569,078

(22) Filed: Aug. 7, 2012

(51) Int. Cl.
*B65D 43/16* (2006.01)

(52) U.S. Cl.
USPC ..... 220/254.3; 220/849; 220/825; 220/906; 220/238; 220/367.1

(58) Field of Classification Search
USPC ..... 220/265, 268, 269, 906, 254.3, 254.4, 220/233–239, 825, 849, 367.1, 714, 719
See application file for complete search history.

(56) References Cited

U.S. PATENT DOCUMENTS

| | | | | | |
|---|---|---|---|---|---|
| 3,727,787 | A * | 4/1973 | Gregory | 220/243 |
| 3,749,274 | A * | 7/1973 | Mele et al. | 220/825 |
| 3,871,552 | A * | 3/1975 | Irland et al. | 222/83 |
| 4,024,980 | A * | 5/1977 | Kneusel et al. | 220/260 |
| 4,138,033 | A * | 2/1979 | Payne et al. | 220/254.3 |
| 4,195,749 | A * | 4/1980 | Hawkins | 220/268 |
| 4,429,804 | A * | 2/1984 | Pease | 220/247 |
| 4,717,039 | A | 1/1988 | Ayyoubi | |
| 4,747,511 | A * | 5/1988 | Dutt et al. | 220/254.2 |
| 4,804,103 | A * | 2/1989 | Goldberg | 220/251 |
| 4,852,763 | A | 8/1989 | Dimberio | |
| 4,880,136 | A | 11/1989 | Englert | |
| 5,421,472 | A | 6/1995 | Beckertgis | |
| 5,810,189 | A * | 9/1998 | Baker | 220/257.2 |
| 6,588,617 | B1 | 7/2003 | Majcen et al. | |
| 6,752,092 | B2 * | 6/2004 | Beattie et al. | 109/75 |
| 2006/0175332 | A1 * | 8/2006 | Serra | 220/269 |

FOREIGN PATENT DOCUMENTS

| | | |
|---|---|---|
| WO | WO98/49066 | 11/1998 |

* cited by examiner

*Primary Examiner* — J. Gregory Pickett
*Assistant Examiner* — James N Smalley
(74) *Attorney, Agent, or Firm* — Michael I. Kroll

(57) ABSTRACT

A resealable tab mechanism for a beverage container having a tab handle with divergent arms with a bar extending therebetween having a gas release pin valve fixedly attached to the tab handle bar. The tab handle is pivoted from a closed position in arc-like fashion that will bend the tab plate downward then the tab handle is rotated in circular fashion providing full access to the beverage container's contents. To close the process is reversed by rotating the tab handle over the beverage container's aperture then pivoted back to its seated position compressing a pair of gaskets that hermetically seals the beverage container's contents.

9 Claims, 15 Drawing Sheets

GAS RELEASE RESEALABLE TAB MECHANISM FOR A BEVERAGE CONTAINER

BACKGROUND OF THE INVENTION

1. Field of the Invention

The present invention relates generally to pop-top cans and, more specifically, to a gas release tab mechanism for a beverage container having a tab handle extending to divergent arms with a bar fixed therebetween having a pin valve extending from the tab plate bar through the tab plate with a pin valve gasket seated about the base of the pin valve. Further providing a tab plate gasket that in combination with the pin value gasket seals the tab opening when moved to a closed state.

To open, the tab handle is raised causing the tab handle bar to move the pin valve to an open state releasing gas pressure while also moving the tab plate from the end cap aperture where then the tab handle is manipulated to position the tab arms into the end cap aperture then rotating the tab handle until the tab arms are positioned under the end cap. The tab handle is then returned to its seated position thereby pushing the tab plate downward into to a fully open state. To close the tap plate, the tab handle is raised and rotated thereby moving the arms from under the end cap and rotating the tab until the tab arms are positioned on top of the end cap wherethen the tab handle is returned to its seated position thereby holding the tab plate securely against the end cap aperture therein sealing the beverage container.

2. Description of the Prior Art

There are other opening devices designed for beverage containers. While these opening devices may be suitable for the purposes for which they where designed, they would not be as suitable for the purposes of the present invention as heretofore described.

It is thus desirable to provide a beverage container opener comprising a tab mechanism incorporating a gas release valve to release gas pressure prior to opening the beverage container aperture.

It is further desirable to provide a beverage container having a tab handle that is subjacently positioned to the beverage container aperture.

It is additionally desirable to provide a tab handle having tab arms that can be manipulated to keep the tab plate in an open or closed position.

SUMMARY OF THE PRESENT INVENTION

A primary object of the present invention is to provide a beverage container having an end cap spaced away from a bottom end with a wall extending between said end cap and said bottom end with a tab mechanism fastened to said end cap that can be moved from a closed state to an open state back to a closed state providing access to a beverage within said beverage container.

Another object of the present invention is to provide the end cap with an aperture so that a beverage can be selectively removed from said beverage container through said container aperture by manipulating the tab mechanism to an open state.

Another object of the present invention is to provide a beverage container that once a portion of the contents are removed the remainder of the container's contents can be hermetically sealed within said container by manipulating the tab mechanism to a closed position.

Another object of the present invention is to provide an exteriorly extending ridge about said end cap aperture thereby forming a channel on the underside of said end cap encompassing the end cap aperture.

Another object of the present invention is to provide a tab mechanism comprising an end cap gasket, tab handle, tab plate and pin valve incorporating a base flange.

Another object of the present invention is to provide the end cap with a fastener aperture and the tab plate with a tab plate fastener aperture that when co-aligned provides for an end-cap tab-plate fastener inserted therethrough securing said the tab plate portion of the tab mechanism to said end cap.

Another object of the present invention is to have said end cap gasket positioned within the end cap channel of the beverage container end cap that circumferentially encompasses the end cap aperture.

Another object of the present invention is to have the tab plate ridge co-aligned with the underside of the beverage container end cap channel having the gasket therein so that the tab plate ridge engages the end cap gasket thereby forming closure of the end cap aperture.

Another object of the present invention is to have said tab plate gasket positioned within the channel on the underside of the beverage container end cap that circumferentially encompasses the end cap aperture.

Another object of the present invention is to provide said tab plate with a pin aperture having a ridge circumferentially encompassing said tab plate pin aperture thereby forming a channel on the underside of said tab plate encompassing the tab plate pin aperture.

Another object of the present invention is to provide a tab handle frame having a finger aperture for ease of opening with the frame having divergent arms on the distal end with a bar extending between the arms.

Another object of the present invention is to provide a tab handle wherein said arms extend downwardly from said tab handle positioned on opposing sides of the end cap aperture.

Another object of the present invention is to provide a valve pin having a notch forming receptacle for mounting to the bar extending between the tab arms.

Another object of the present invention is to provide a valve pin body having a curvilinear indentation.

Another object of the present invention is to provide said valve pin with a base positioned flange.

Another object of the present invention is to provide a gasket positioned on the pin base flange.

Additional objects of the present invention will appear as the description proceeds.

The present invention overcomes the shortcomings of the prior art by providing a resealable pop-top type opener for a can having a curvilinear tab handle extending to divergent arms having a post fixed therebetween. A tab hinge is mounted to the tab plate with the hinge knuckle encompassing the hinge post so that the curvilinear tab handle can be pivoted from a substantially horizontal direction to a vertical direction whereupon the tab arms are used to manipulate the tab to either an open position or if open to a closed position.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
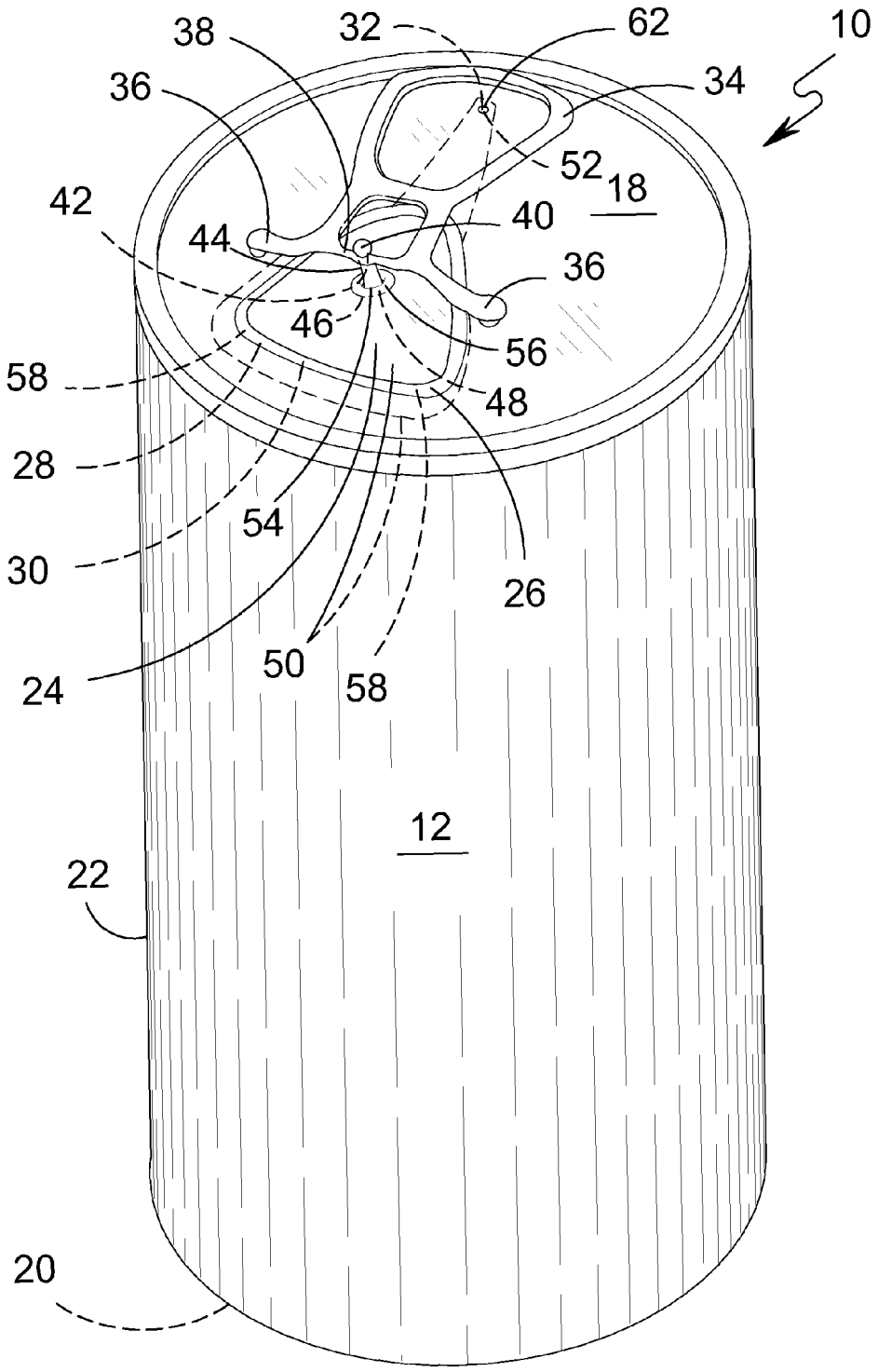
FIG. 1 is an illustrative view of the resealable tab mechanism for a beverage container.

Turning now descriptively to the drawings, in which similar reference characters denote similar elements throughout the several views, the figures illustrate the Resealable Pop-Top Style Tab Opener for Containers of the present invention. With regard to the reference numerals used, the following numbering is used throughout the various drawing figures.

10 Resealable Tab Mechanism for Beverage Containers of the present invention
12 beverage container
14 beverage
16 carbonation
18 end cap
20 bottom side
22 wall
24 end cap aperture
26 end cap ridge
28 end cap channel
30 end cap channel gasket
32 end cap fastener aperture
34 tab handle
36 tab handle arms
38 tab handle bar
40 pin
42 bar catch
44 pin indentation
46 pin flange
48 tab plate gasket
50 tab plate
52 tab plate fastener aperture
54 tab plate pin aperture
56 tap plate pin ridge
58 tab plate ridge
60 tab plate pin channel
62 end-cap tab-plate fastener

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the resealable tab mechanism 10 for a beverage container 12. The present invention provides a resealable tab mechanism 10 for a beverage container 12 incorporating a gas release pin valve 40. The tab mechanism 10 comprises a tab handle 34 longitudinally extending to a pair of transverse arms 36 having a tab handle bar 38 extending therebetween that forms anchor for the aforementioned gas release pin valve 40. The tab mechanism further incorporates a tab plate 50 subjacently fixed to the beverage end cap 18 through tab plate fastener aperture 52 by end-cap tab-plate fastener 62. End cap 18 also has aperture 24 passing therethrough, which provides access to the beverage container contents and provides a peripherally positioned ridge 26 that forms channel 28 on the underside of beverage container 12 end cap 18 for placement therein of end cap channel gasket 30. Tab plate 50 also has a substantially correspondingly shaped ridge 56 as ridge 26 that compresses channel gasket 30 within end cap channel 28 when the tab handle 34 is in the closed state. Tab plate 50 provides another ridge 56 encompassing tab plate pin aperture 54 with the ridge forming tab plate channel 60 on the bottom side of the tab plate forming receptacle for a tab plate gasket 48. Pin valve 40 has bar catch 42 for securing pin valve 40 to the tab handle bar 38 with the pin valve having a shaft terminating at a pin flange 46, which forms support for tab plate gasket 48 and compresses tab plate gasket 48 within tab plate channel 60 thereby sealing tab plate pin aperture 54.

To open, tab handle 34 is raised from its closed state causing pin 40 fastened to tab handle bar 38 to move downwardly thereby initially releasing any gas. As the tab handle is further moved to its fully open state, tab plate 50 bends into the beverage container 12 wherethen the tab handle is rotated away from end cap 18 aperture 24 providing access to the contents of beverage container 12. To hermetically seal the beverage container 12 having any unused beverage therein the tab handle is again rotated back over aperture 24 wherethen tab handle 34 is pivoted back to its closed state causing pin 40 to compress gasket 40 into tab plate channel 60 by virtue of pin flange ridge 58 and gasket 30 to be compressed within end cap channel 28 by virtue of tab plate ridge 58 thereby providing a hermetic seal for the beverage container 12.

Figure 2:
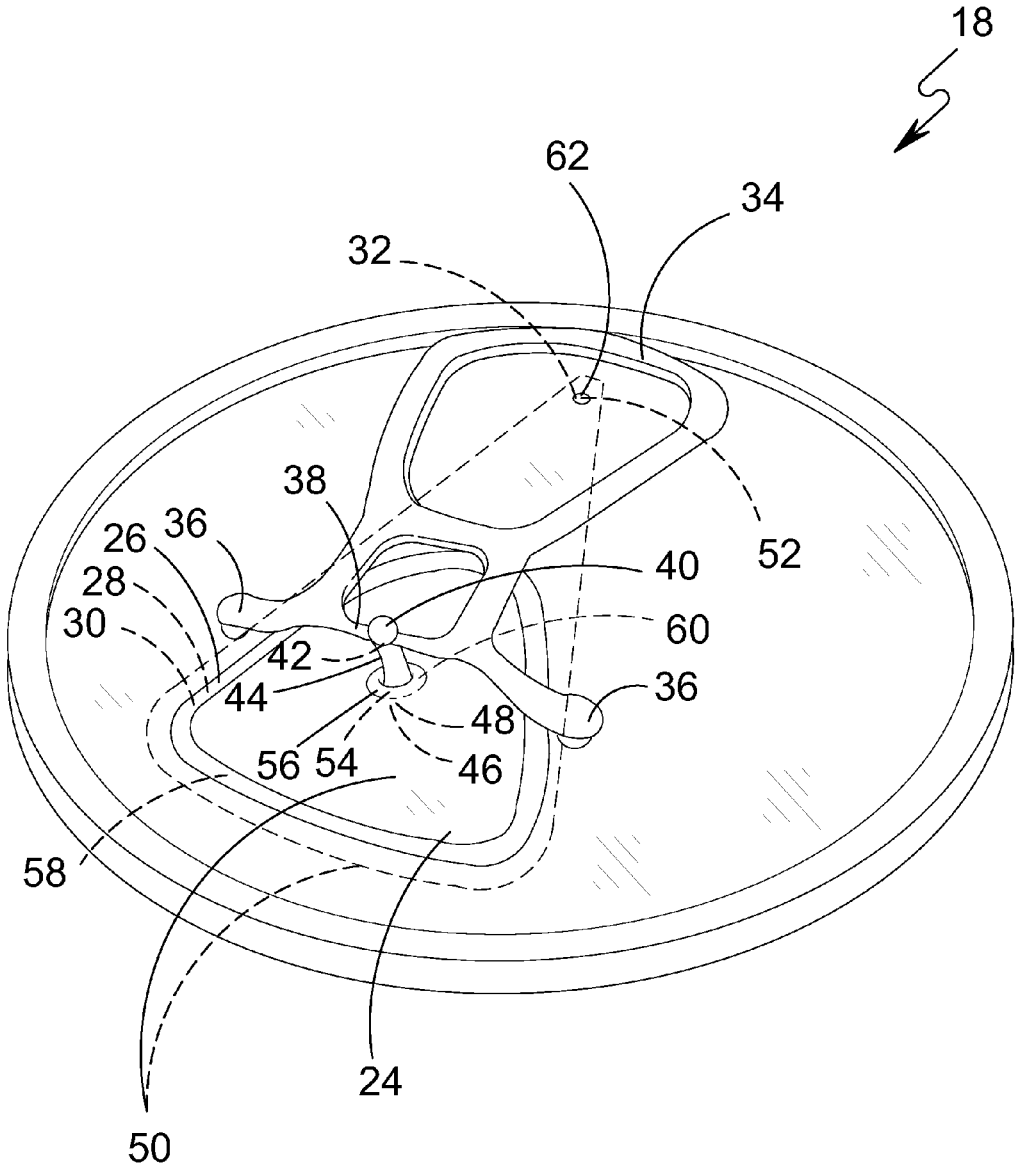
FIG. 2 is the end cap tab mechanism for a beverage container.

Referring to FIG. 2, shown is the end cap tab mechanism for a beverage container. Depicted is the tab mechanism for end cap 18 comprising tab handle 34 extending into arms 36 with bar 38 therebetween serving as pivot point for bar catch 42 of pin 40. End cap 18 has aperture 24 for removal of the beverage once opened. Tab plate 50, which subjacently covers aperture 24, is fastened to the end cap through co-aligned aperture 32, 52 by end-cap tab-plate fastener 62 and is displaceable through pin 40. The tab plate is manufactured with a peripheral ridge 58 that substantially corresponds in shape to the end cap channel 28 created by end cap ridge 26 with gasket 30 positioned within channel 28 and deformable by tap plate ridge 58 when the tab plate is closed. Pin 40 passes through tab plate aperture 54 in tab plate 50 terminating in pin flange 46, which supports tab plate gasket 48 within tab plate pin channel 60 formed by tab plate ridge 58.

Figure 3:
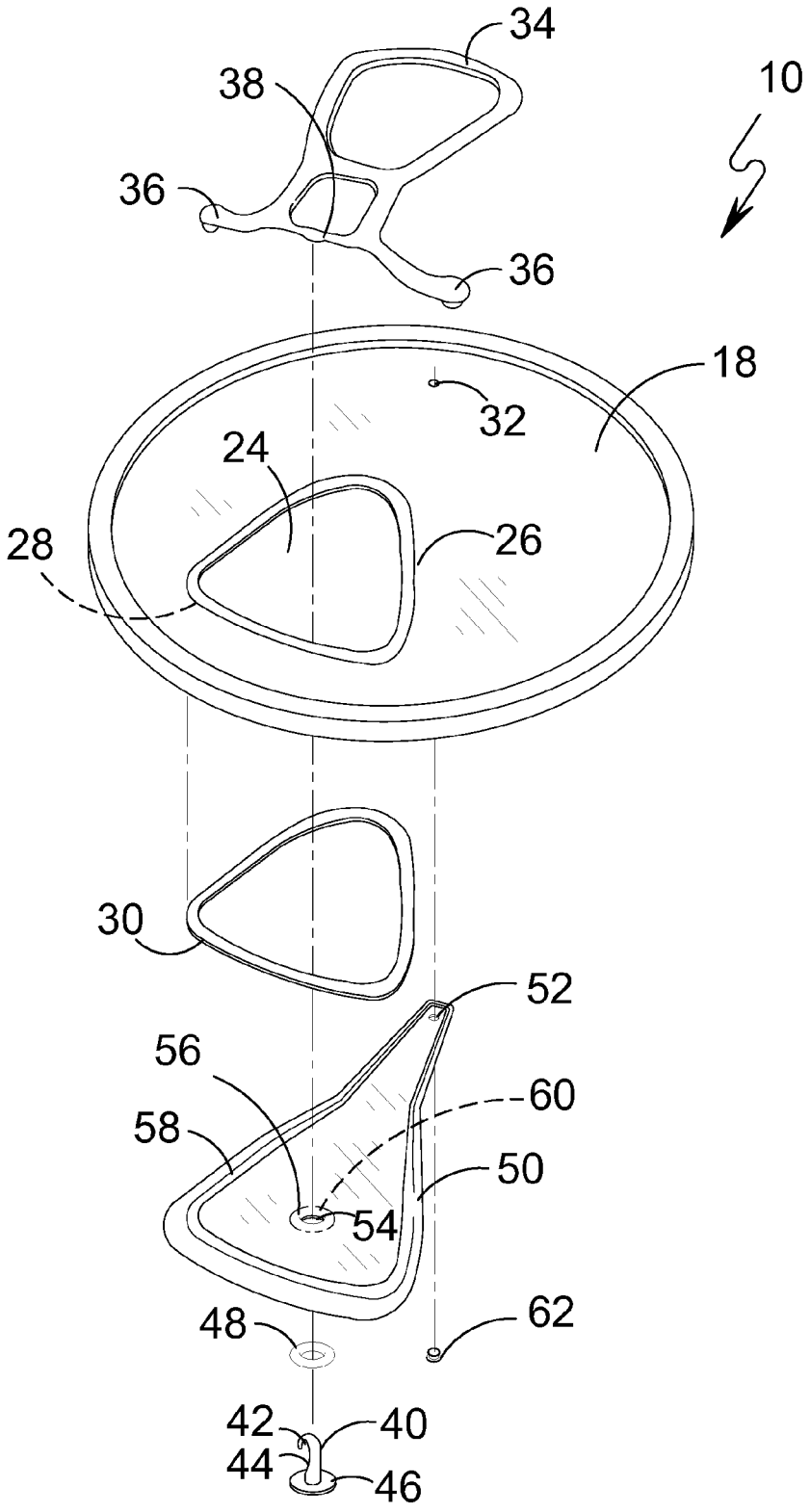
FIG. 3 is an exploded view of the resealable tab mechanism for an end cap for a beverage container.

Referring to FIG. 3, shown is an exploded view of the resealable tab mechanism for an end cap for a beverage container. The present invention is a resealable tab mechanism 10 for a beverage container, such as pop-top type beverage container 12 having a tab handle 34 that extends to a pair of divergent arms 36 having a tab handle bar 38 therebetween pivotally attached to pin 40. End cap 18 provides aperture 24 as port to a beverage content that typically would have to be consumed once the scored opening had been made. The present invention provides that the opening can be resealed to preserve the beverage contents until desired. Pin 40 is attached to tab plate 50 subjacently covering end cap 18 aperture 24. Tab plate 50 provides ridge 58 that applies a closed state force to gasket 30 positioned within channel 28 of end cap ridge 26 thereby sealing end cap aperture 24. Tab plate 50 provides a second aperture 54 for passage of pin 40 with ridge 56 encompassing aperture 54 and forming tab plate pin channel 64 for receiving tab plate gasket 60. Tab plate gasket 60 seals aperture 52 through force applied by tab pin flange 46 at the base of pin 40.

Figure 4:
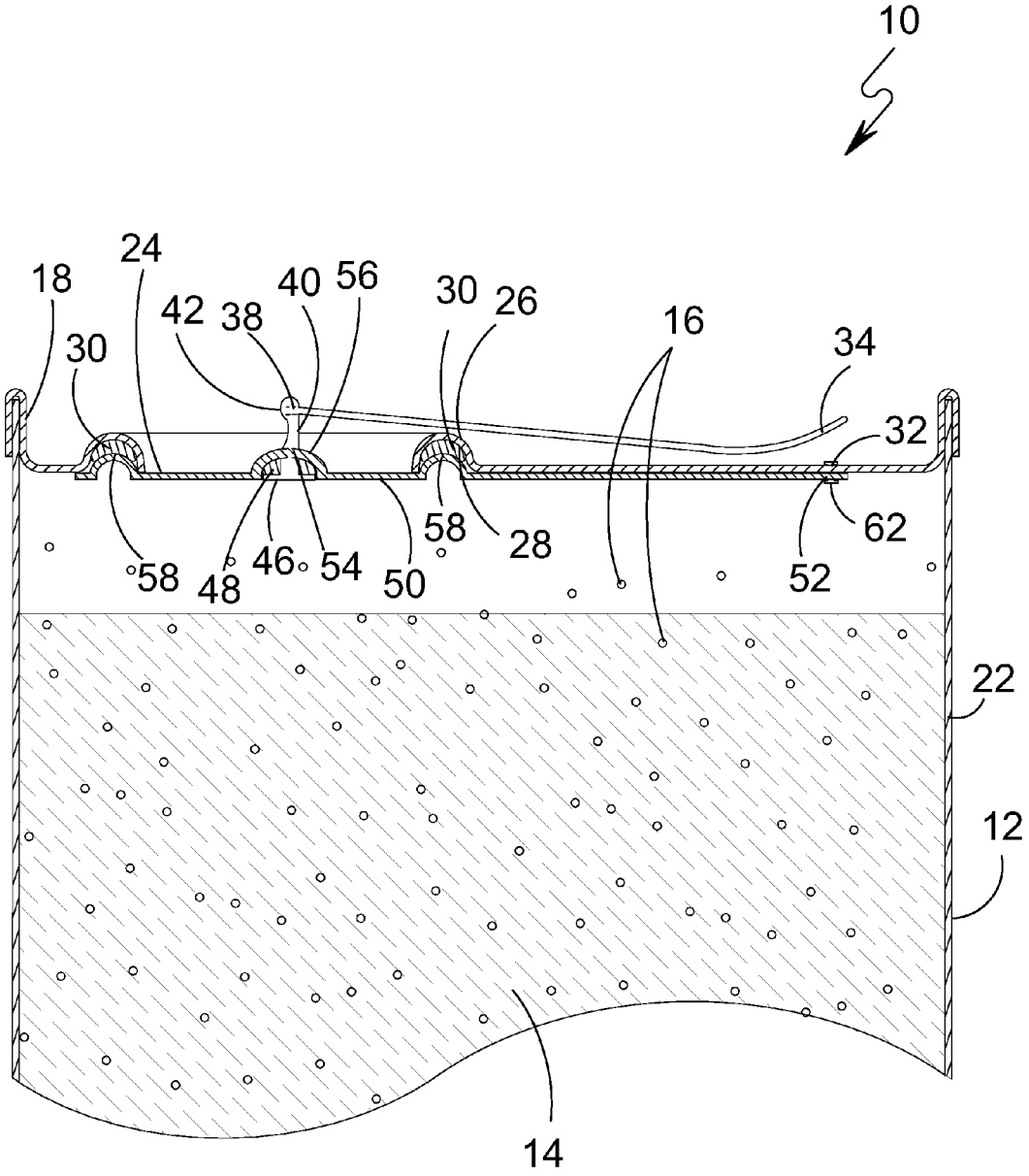
FIGS. 4 through 6 are cutaway progression views of the tab mechanism of the present invention.
Figure 5:
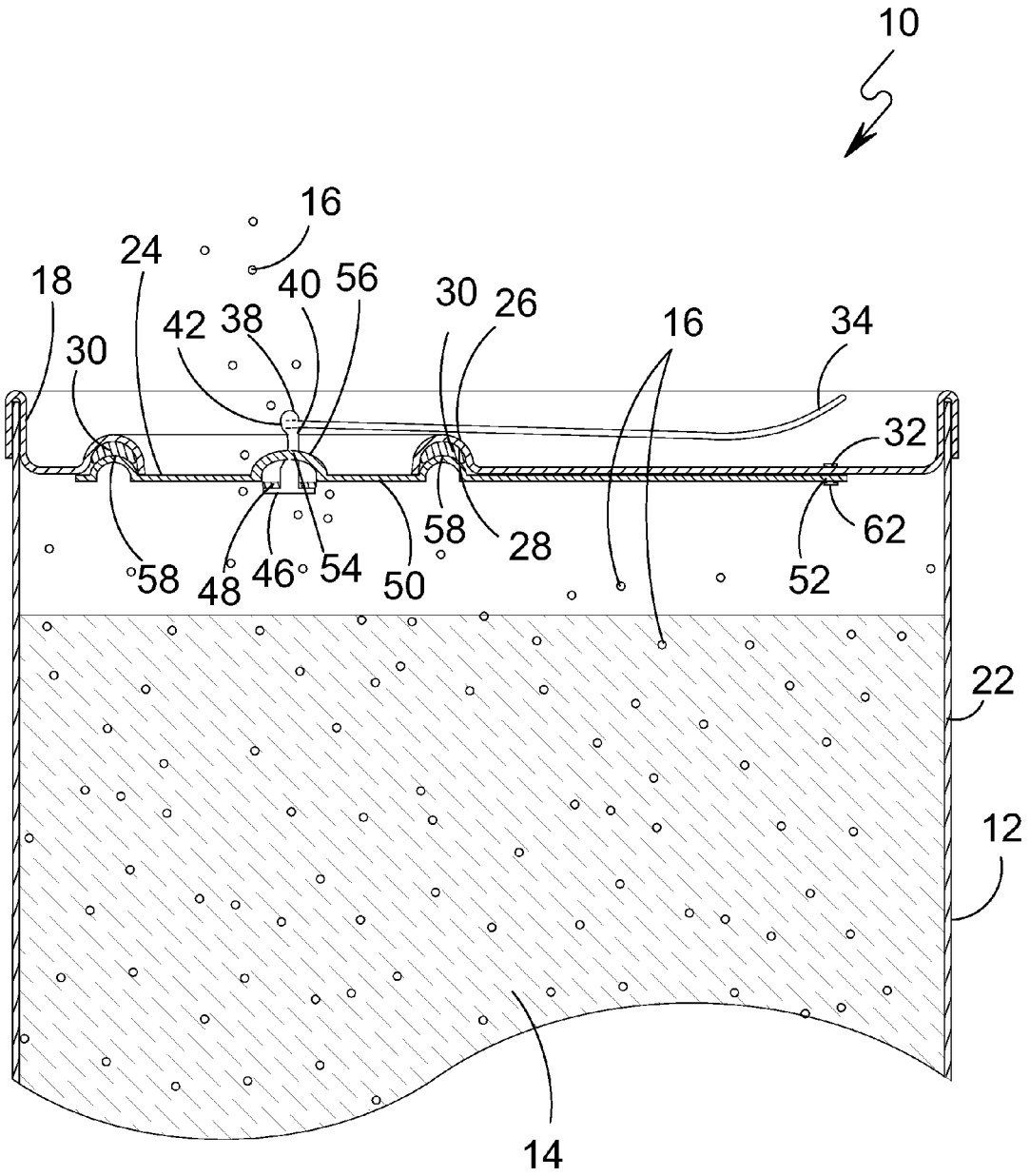
Figure 6:
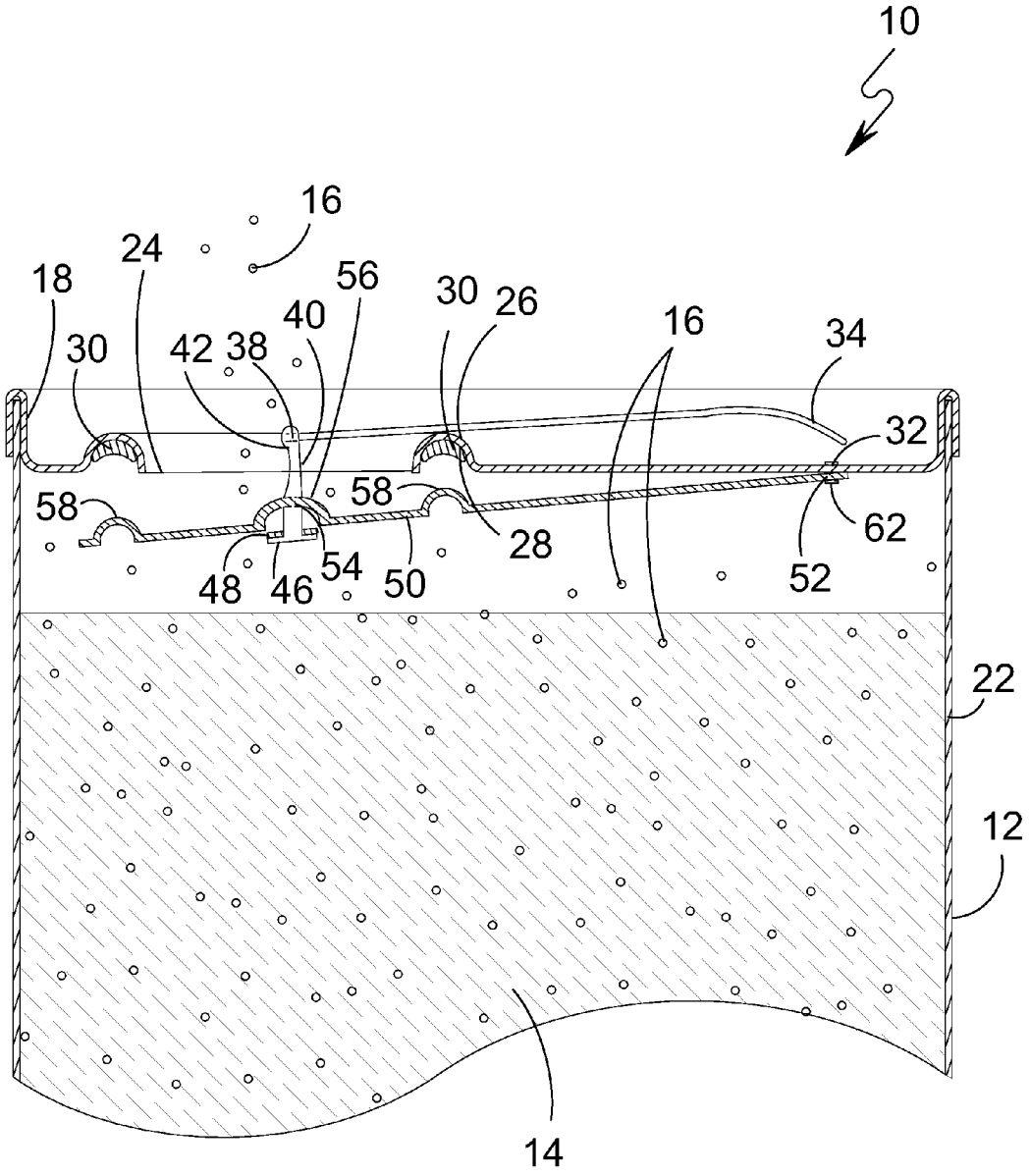

Referring to FIGS. 4 through 6, shown are cutaway progression views of the tab mechanism of the present invention. FIG. 4 depicts the tab mechanism 10 in its closed state secured to end cap 18 that is fastened to wall 22 of beverage container 12. End cap 18 has beverage access aperture 24 that is hermetically sealed by gasket 30 that is in a compressed state between end cap 18 and tab plate 50, and gasket 48, which is also in a compressed state within tap plate pin channel 60 by virtue of tab pin flange 46. FIG. 5 shows tab handle 34 in a partially raised position moving pin 40 downward that initially releases gas 16 through tab plate pin aperture 54. FIG. 6 shows the tab plate in its open position providing access to the beverage container contents.

Figure 7:
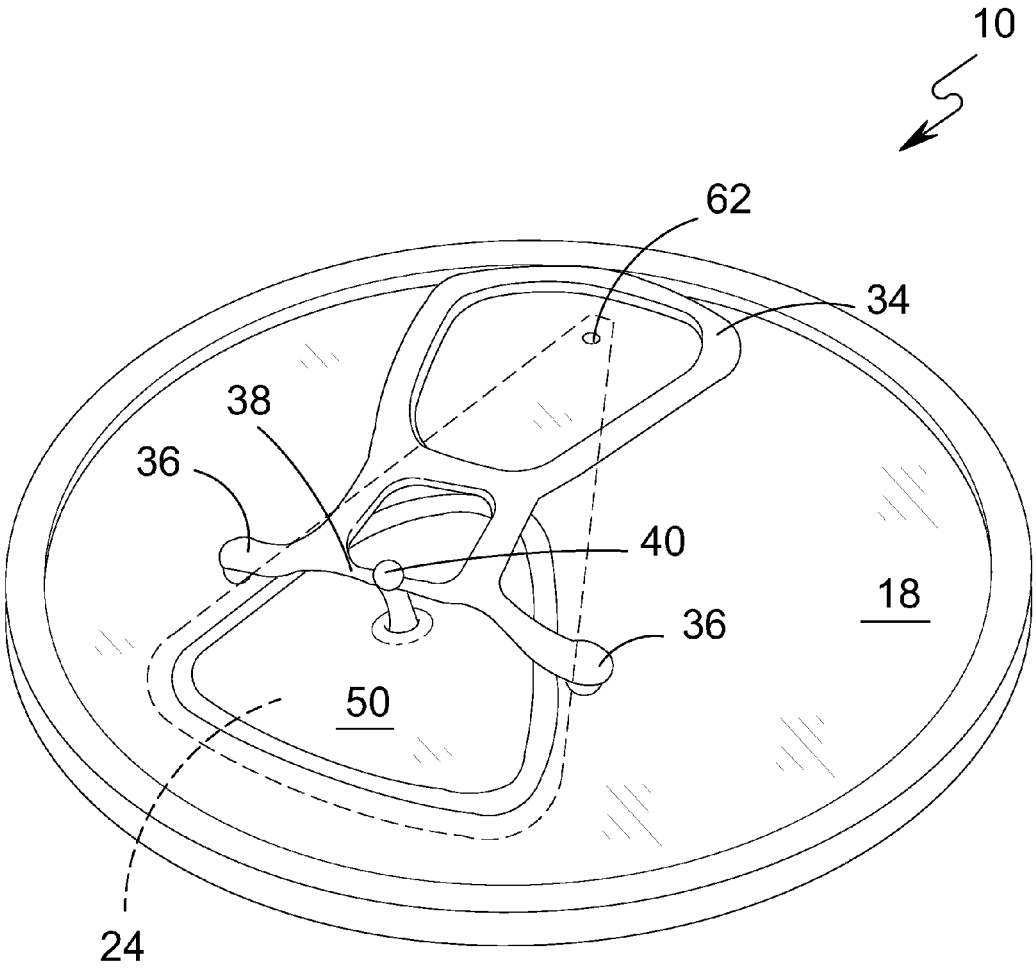
FIGS. 7 through 15 are stepwise views of the opening procedures to gain access to the beverage container contents and closing procedures to hermetically seal a previously opened beverage container having the tab mechanism of the present invention.
Figure 8:
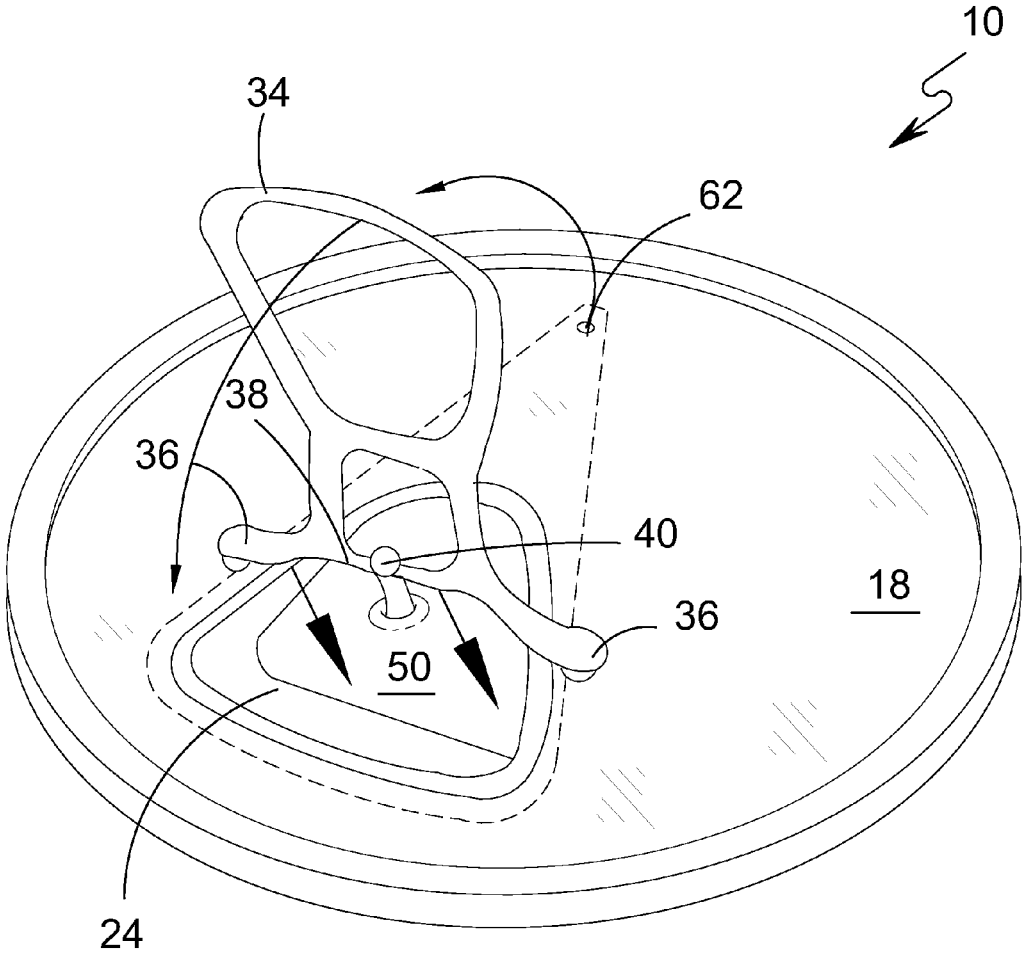
Figure 9:
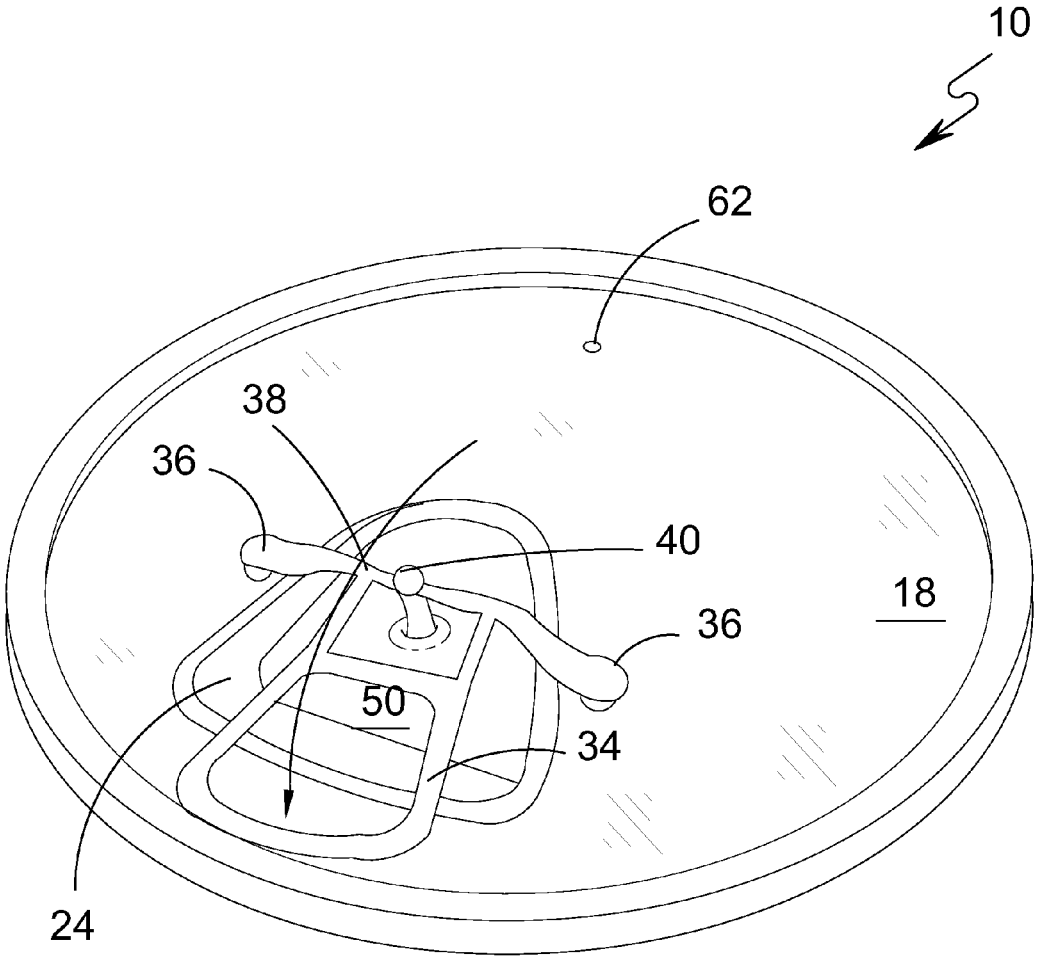
Figure 10:
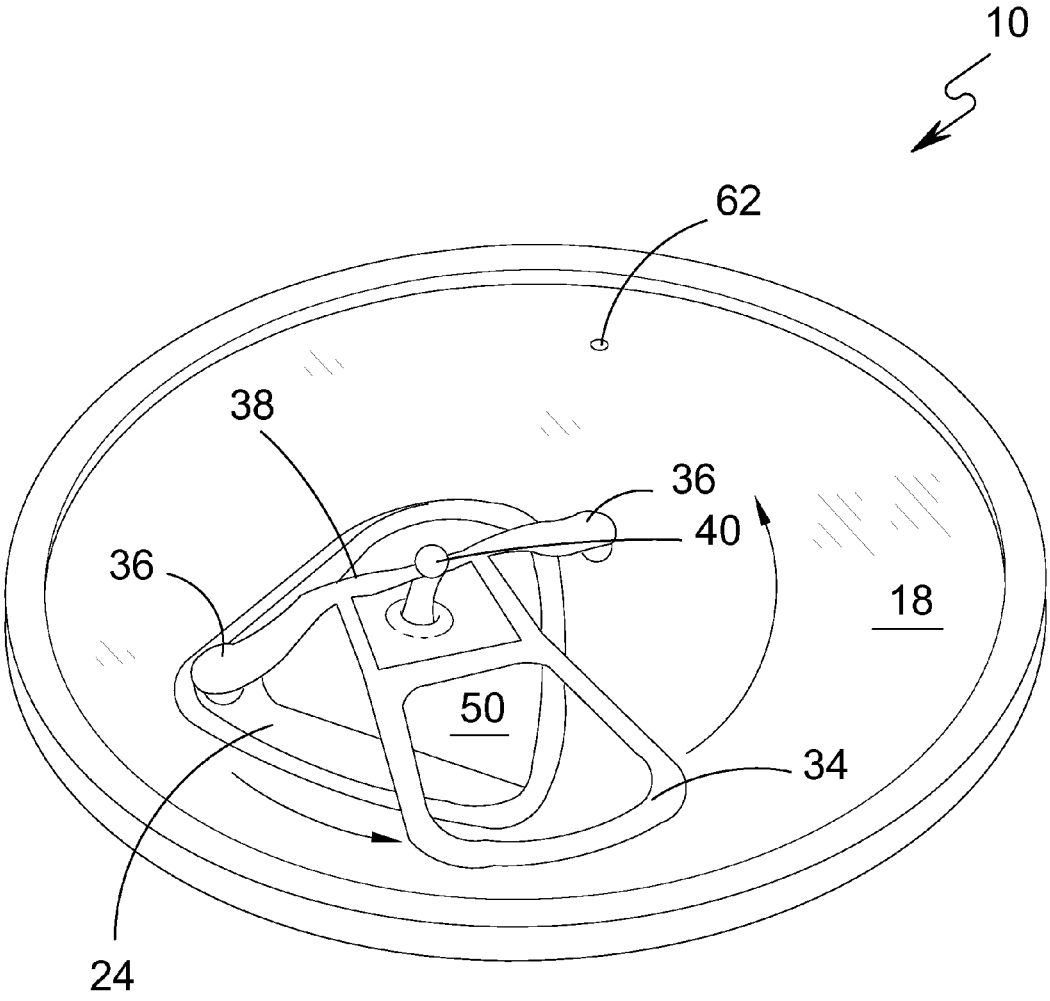
Figure 11:
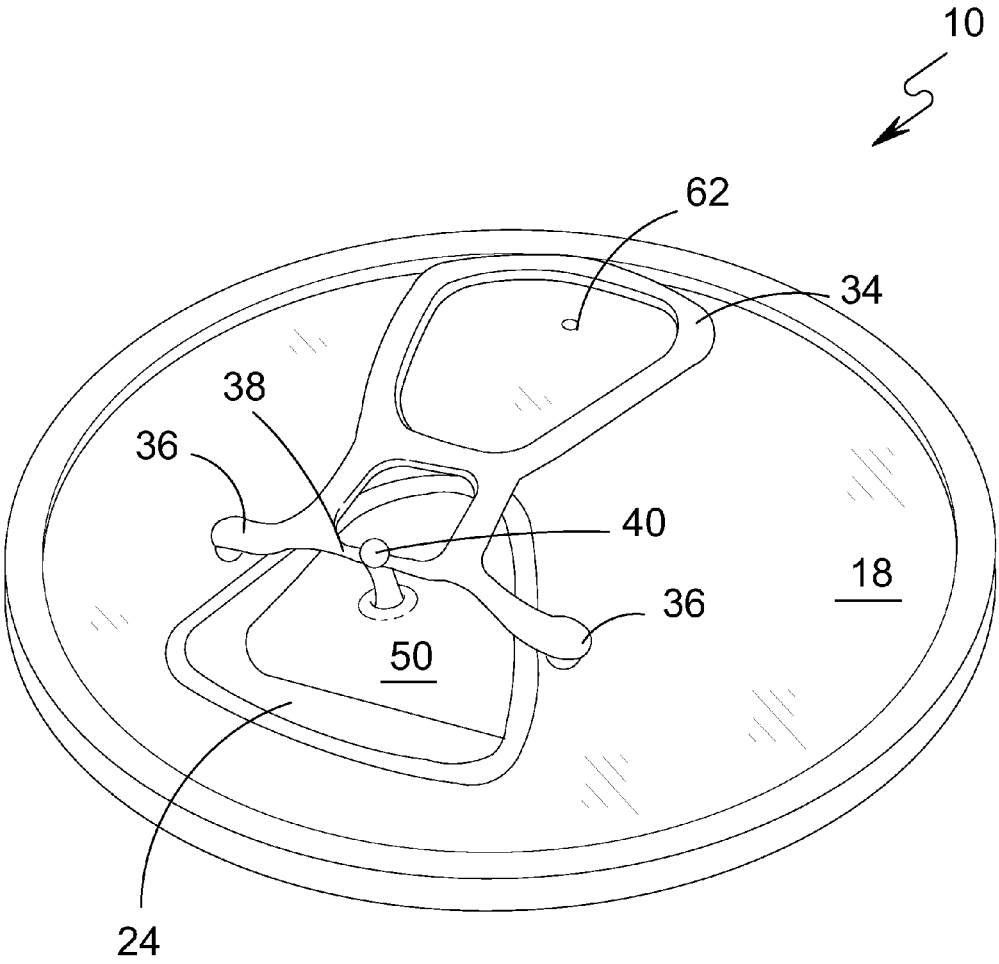
Figure 12:
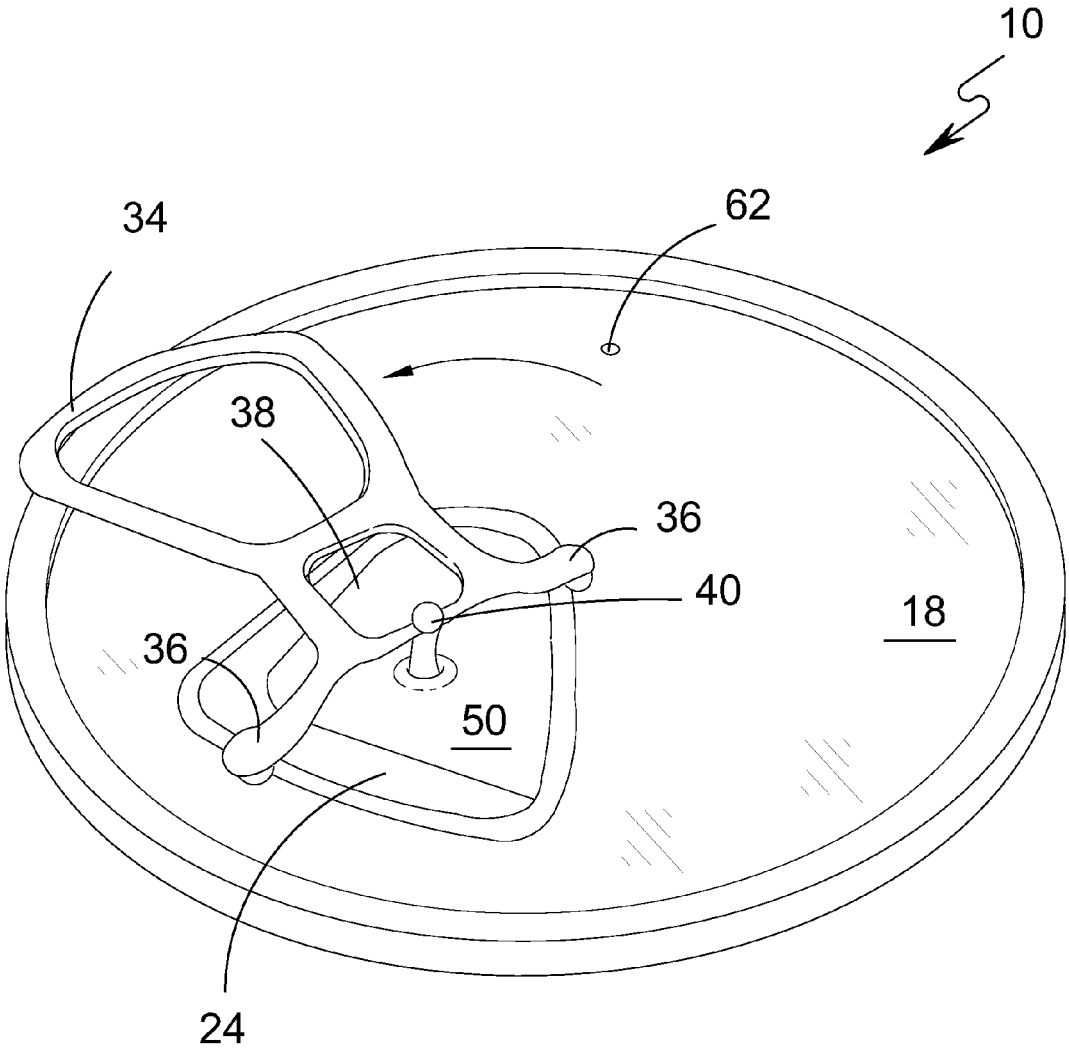
Figure 13:
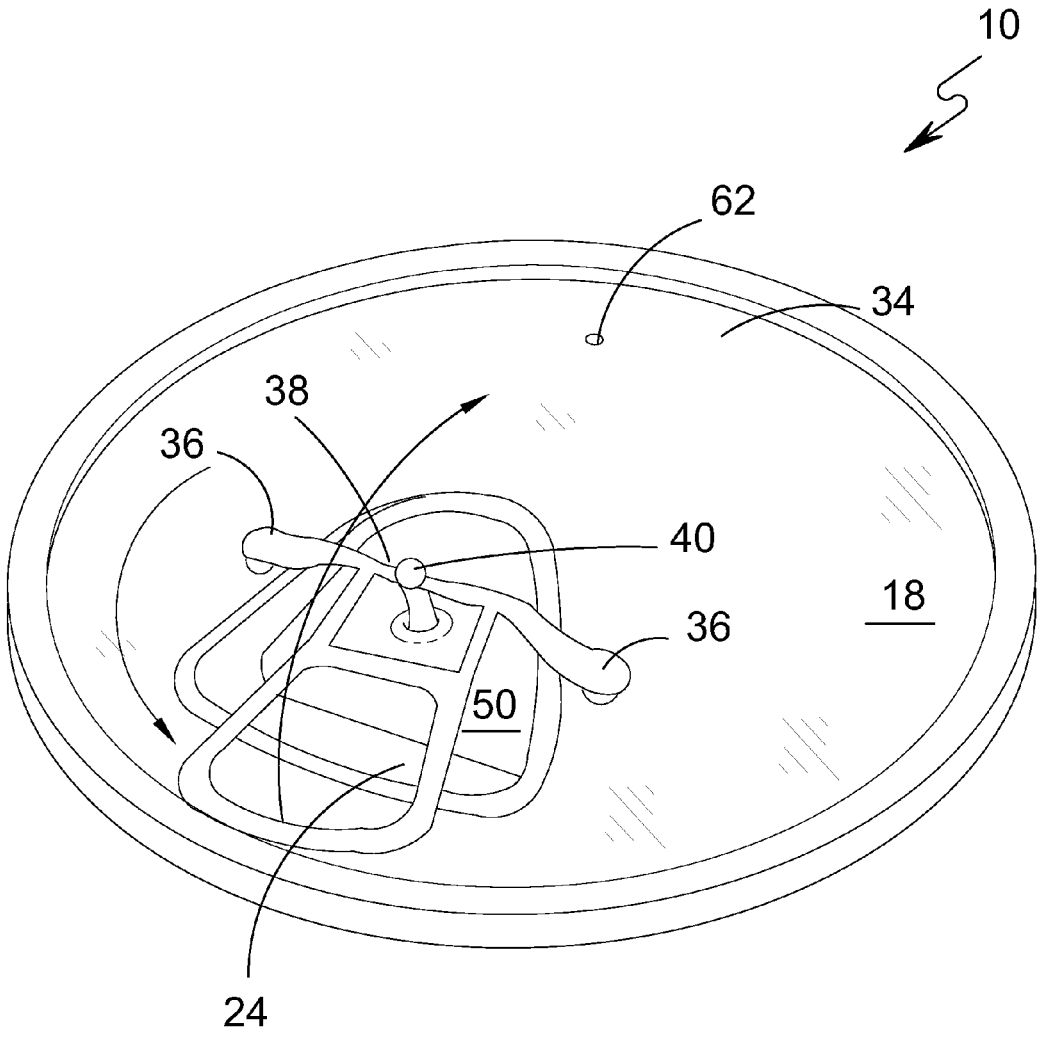
Figure 14:
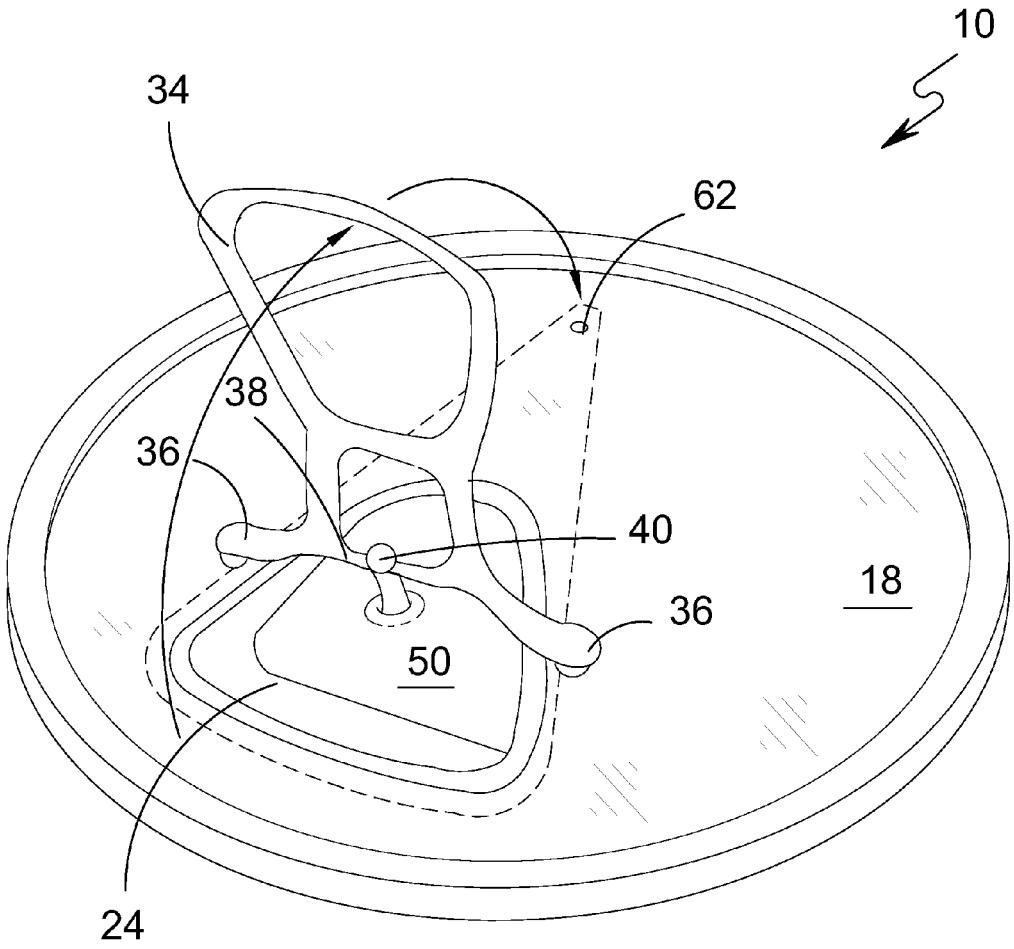
Figure 15:
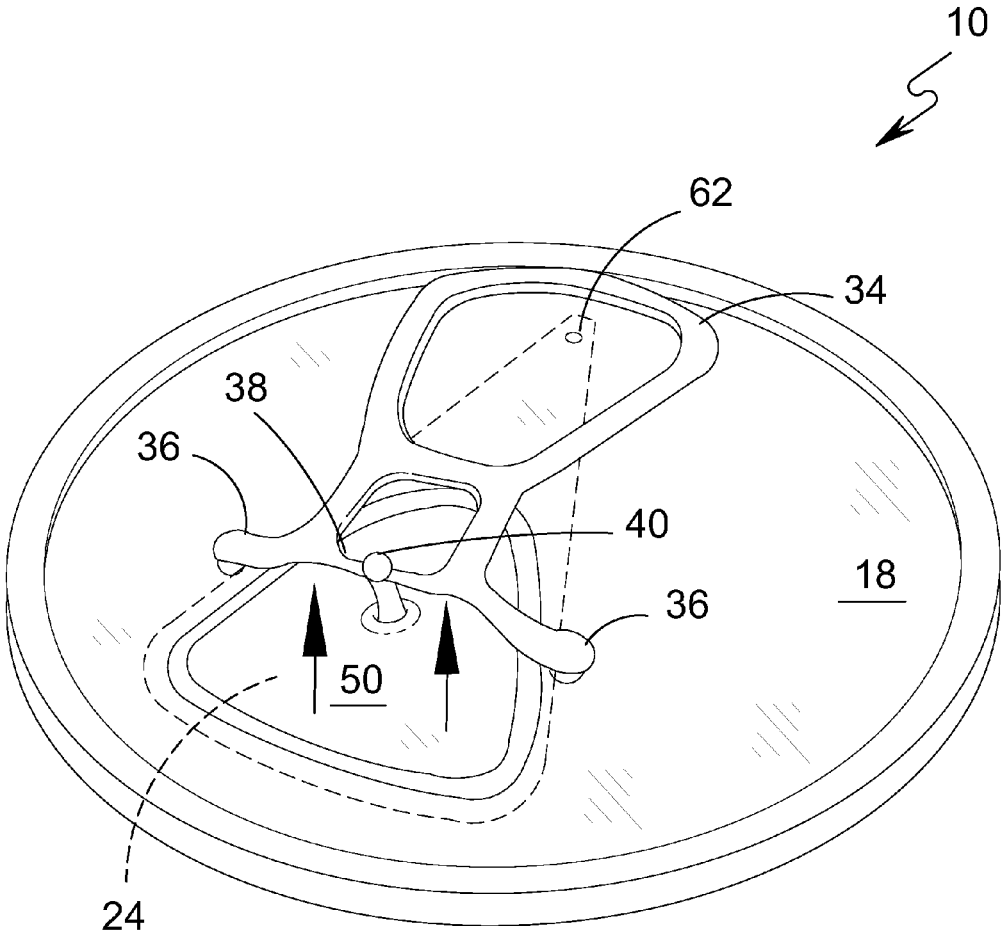

Referring to FIGS. 7 through 15, shown are stepwise views of the opening procedures to gain access to the beverage container contents and closing procedures to hermetically seal a previously opened beverage container having the tab mechanism of the present invention. FIG. 7 shows the tab mechanism 10 for an end cap 18 comprising a tab handle 34 having arms 36 located on opposing sides end cap aperture 24 with bar 38 forming pivot point for pin 40. Also shown is end-cap tab-plate fastener 62, which fastens tap plate 50 to end cap 18. FIGS. 8 and 9 depict the opening of end cap aperture 24 through pivoting the tab handle 34 in arc-like fashion forcing pin 40 downward thereby pushing tab plate 50 downward. Once opened, the tab handle is rotated, as shown in FIG. 10, away from aperture 24 until positioned opposing aperture 24 as shown in FIG. 11 thereby providing access to the beverage. To reseal the beverage container, the opening process is reversed as shown in FIG. 12, where the tab is rotated until superjacently positioned over aperture 24 then pivoted back to its closed position, as shown in FIGS. 13 and 14, whereupon the aforementioned gaskets 30, 48 hermetically seal the tab plate 50 to end cap aperture 18.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired by Letters Patent of the United States is:

1. A resealable tab mechanism for accessing and storing the contents of a beverage container comprising:

a) a beverage container having an end cap, a bottom side and a wall extending therebetween;

b) said end cap having an aperture passing therethrough; and c) an end cap subjacent tab mechanism having a tab plate hinged to said end cap that is movable between a closed state, an open state and back to a closed state wherein said closed state hermetically seals a beverage within said beverage container and wherein said open state provides access to said beverage through said end cap aperture;

d) said tab mechanism including a pivotable tab handle on said tab plate having divergent tab handle arms and a tab handle bar positioned between said tab handle arms;

e) wherein pivoting of said tab handle in arc-like fashion until superjacently positioned relative to the end cap aperture further causes the tab plate downward movement to its open state whereupon when the tab handle is rotated back to its starting position the container is resealed thereby providing later access to the beverage container contents.

2. The resealable tab mechanism for accessing and storing the contents of a beverage container as recited in claim 1, wherein said tab mechanism further provides a pin valve for releasing gas from a carbonated beverage as said tab mechanism is moved from a closed state to an open state.

3. The resealable tab mechanism for accessing and storing the contents of a beverage container as recited in claim 1, wherein said end cap further provides a ridge that peripherally encompasses said end cap aperture.

4. The resealable tab mechanism for accessing and storing the contents of a beverage container as recited in claim 3, wherein said end cap ridge forms an end cap channel on an under side of said end cap.

5. The resealable tab mechanism for accessing and storing the contents of a beverage container according to claim 4, further comprising an end cap channel gasket positioned within said end cap channel.

6. The resealable tab mechanism for accessing and storing the contents of a beverage container as recited in claim 1, wherein rotation of said handle to a superjacent position relative to said end cap aperture and then pivoting the tab handle to its closed seated position reseals the beverage container to retain the remaining contents therein.

7. A resealable pop-top style tab mechanism for a can comprising:

a) a can with end cap having an aperture;

b) a malleable tab plate subjacently fastened to said end cap;

c) a tab handle having a proximal end and a distal end disposed on a top portion of said end cap;

d) a handle having a bar and a pair of divergent arms projecting from opposing ends of said bar;

e) a pin extending up through a pin aperture in said tab plate and having an upper end encircling said bar; and f) wherein said divergent arms extend beyond the width of said end cap aperture and maintain contact with a top portion of said end cap;

g) wherein pivoting said handle in arc-like fashion results initially in the pin moving downwardly thereby initially releasing any carbonated gas then moving the tab plate downwardly to its open position and further rotation of said tab handle from its superjacent position relative to the end cap aperture provides full access to the beverage container's contents; and h) wherein then pivoting the tab handle back to its closed position reseals the beverage container.

8. The resealable tab mechanism for a can recited in claim 7, wherein the beverage container comprises a pin aperture gasket and a tab plate gasket which are compressed to reseal the beverage container when the handle is returned to the closed position.

9. A resealable tab mechanism for accessing and storing the contents of a beverage container comprising:

a) a beverage container having an end cap, a bottom side and a wall extending therebetween;

b) said end cap having an aperture passing therethrough;

c) an end cap subjacent tab mechanism having a tab plate hinged to said end cap that is movable between a closed state, an open state and back to a closed state wherein said closed state hermetically seals a beverage within said beverage container and wherein said open state provides access to said beverage through said end cap aperture;

d) said tab plate peripherally extending beyond said end cap aperture incorporating a ridge that also peripherally extends beyond said top side aperture and has an end-cap tab-plate fastener securing the tab plate to the under side of said end cap;

e) a pivotable tab handle on said tab plate having tab handle arms and a tab handle bar positioned between said tab handle arms;

f) a pin valve in said tab plate engaged with said tag handle bar;

g) whereby pivoting a distal end of said handle results in said handle bar applying a downward bias to the pin valve causing said pin valve downward releasing any compressed gas.

* * * * *